United States Patent [19]

Pertl

[11] Patent Number: 4,538,544

[45] Date of Patent: Sep. 3, 1985

[54] MACHINE FOR SURFACING FLOORS

[76] Inventor: Peter Pertl, Tulpenweg 3, 8200 Rosenheim, Fed. Rep. of Germany

[21] Appl. No.: 536,777

[22] Filed: Sep. 28, 1983

[30] Foreign Application Priority Data

| | | | |
|---|---|---|---|
| Oct. 4, 1982 | [DE] | Fed. Rep. of Germany | 3236686 |
| Oct. 4, 1982 | [DE] | Fed. Rep. of Germany | 3236687 |
| Oct. 4, 1982 | [DE] | Fed. Rep. of Germany | 3236688 |
| Feb. 10, 1983 | [DE] | Fed. Rep. of Germany | 3304632 |
| Feb. 10, 1983 | [DE] | Fed. Rep. of Germany | 3304639 |

[51] Int. Cl.[3] ..... B05C 11/02

[52] U.S. Cl. ..... 118/665; 118/668; 118/111; 118/106; 118/110; 51/47

[58] Field of Search ..... 118/108, 110, 668, 111, 118/106, 207, 305, 665; 51/47, 176

[56] References Cited

U.S. PATENT DOCUMENTS

| | | | |
|---|---|---|---|
| 1,171,627 | 2/1916 | Muller | 118/111 |
| 3,783,819 | 1/1974 | Hammelmann | 118/305 X |
| 3,936,853 | 2/1976 | Mart | 118/111 X |

*Primary Examiner*—John P. McIntosh

*Attorney, Agent, or Firm*—Orrin M. Haugen; Thomas J. Nikolai; Douglas L. Tschida

[57] ABSTRACT

A machine for surfacing floors by laying down a floor covering compositions, as for example asphalt, comprises an anchoring base that may be braced between two floors or bolted to the floor under it. On the base there is a pivoting boom made up of articulated links with upright pivot axes. At its outer end, there is a floor working head fixed on the boom. The base is made up of two separate leveling units placed at 90 deg to each other as well as a height adjustment unit. By providing a separate anchoring base, it is possible for the floor surfacing machine to be used both indoors and outdoors. It also allows simple and accurate leveling of the end of the boom and facilitates the working of a very wide range of different flooring compositions over large areas.

20 Claims, 21 Drawing Figures

8
IV
VI
541
543
545
581
579
557
553
555
573
565
577
567
551
569
559
525
519
521
523
527
593
595
533
587
591
511
585
561
575
571
531
529
537
539
535
589

MACHINE FOR SURFACING FLOORS

BACKGROUND OF THE INVENTION

The present invention relates generally to a machine for surfacing floors by applying and processing floor covering material, as for example asphalt, and more particularly to a machine comprising a supporting and load bearing unit, a swinging boom made up of articulated links supported on this unit and having a floor processing head on the outer end of the boom. The machine furthermore has two leveling means acting orthogonally to each other and a height adjustment unit.

DISCUSSION OF THE PRIOR ART

An example of a floor surfacing machine along these general lines is shown in German Pat. No. 2,424,150. This known machine includes a load bearing column having its lower end supported on the floor which is in the process of being surfaced and its upper end is braced against the floor of the next story of the building or its roof. There is a swinging boom supported on the column whose free end has at least one head, designed for working on the floor. The height of boom over the unfinished floor is adjustable for maintaining the top of the floor surfacing material or finished covering level.

To make it possible for this machine to be used on large floor areas in a number of rooms and covering them with the screed, the boom, which is capable of being pivoted about the column, is made up of a number of articulated boom links which can be hinged to each other through a certain range of angle.

To make it possible for the floor to be worked and processed properly, it is important that the column be perfectly vertical. For this purpose, the prior art machine has two leveling units placed at an angle of 90 deg in relation to each other and which, however, can only be deployed after the load bearing column has been braced between the floor being worked upon and the unfinished ceiling or floor of the next story. In this case, however, the full bracing force between the two floors (or the floor and the roof) acts on the leveling unit. Precise leveling could be achieved only by putting the horizontal slide of the machine at an angle.

A further shortcoming of the known machine shown in German Pat. No. 2,424,150 is that when it is used in a large, single-story building having only a floor and a roof thereover, it is difficult for the column to be wedged between the floor and the roof or ceiling. Also, in everyday use of the machine, the full weight of the boom arm adds to the force on the leveling unit fixed to the load bearing column. Other drawbacks of the above-described floor surfacing machine resides in the fact that there is no way of adding links to the boom to make it longer if desired for a given job.

It is to be more specially noted that the machine of the German patent does not have any floor surfacing tools whereby a floor covering composition may be quickly and evenly spaced out and screeded level. In fact, the tools offered by the prior art design are not of a sort that can be used to quickly and evenly distribute fusible floor covering material, as for example asphalt.

A further point is that, dependent on the nature of the floor covering material, the known machine is not able to be used for sealing the pores in the floor material because for a high quality sealing certain minimum working pressures are needed which cannot be attained by that machine.

SUMMARY OF THE INVENTION

Taking this prior art into account, one object of the present invention is to overcome the shortcomings of the known machine by providing a floor surfacing machine that may be used for a wide range of different purposes inside buildings and out of doors.

Another object of the present invention is to provide a floor surfacing machine having an accurate and easy-to-use system for leveling the end of the boom.

A further important object of the invention is to provide a machine with an easy-to-use height adjustment system.

Yet another object of the present invention is to provide a machine that may be used for covering large floor areas with floor coverings made of a very wide range of different possible materials, while at the same time making it possible for such coverings to be distributed in a desired manner and then processed.

For effecting these and further objects, a floor surfacing machine of the sort noted is characterized in that the load bearing and supporting unit is in the form of an adjustable anchoring base having a mechanism thereon for locking the adjustable anchoring base against at least one horizontal floor surface. Further, the leveling units are separate from the anchoring base so that by using an adjustable support plate, the swinging boom may be leveled on all sides of the machine by using a link which forms a part thereof. Also, the leveling unit for the working head of the boom is positioned on the end of the boom and/or the working head is joined thereto.

The floor surfacing machine, in keeping with the present invention, may be looked upon as the first machine in the field which is able to be simply manuevered and quickly transported from place to place and in which the boom may be rapidly and accurately leveled. In this respect, the anchoring of the machine on a floor under or over it may be undertaken separately from the leveling operation. Adjustment of the height of the front end of the boom can be accomplished while it is in the process of being used by the worker on the job. Hence, a quick and straightforward adjustment "on the spot" (that is to say without having to go back to the anchored base) is in fact possible. Such a quick and accurate adjustment is, in fact, necessary for use of the floor surfacing machine, especially when it comes to a smooth and even laying of the floor material.

As a further part of the invention, for increasing the range of possible uses thereof, there is a system for pivoting the boom end sideways across the upright lengthways plane of the boom end and a further system for putting the boom end at a slope and for lifting it. It is this the last-named adjustment feature that makes it possible for dish-like hollows in the floor, for example, those around drain openings, to be simply and readily surfaced.

In keeping with one more specially preferred form of the invention, the working head has a horizontally adjustable driving shaft with planing paddles spaced out along it, such paddles having an outer edge generally in the form of a segment of a circle when viewed along the axis of the shaft the paddles being fixed to their driving shaft, so that they are all at roughly the same angle to it. This makes it possible for fusible floor covering compositions, such as asphalt, to be evenly spread out and for the superfluous material to be cleared away.

As part of a still further aspect of the invention, the planing paddles have a unit for heating them so as to keep the softened floor covering material from sticking to the paddles and hardening thereon. The heating unit may, for example be one with burners, or with electric heating coil elements within the planing paddles.

In keeping with a further teaching of the invention, the floor working head has at least one smoothing disk, and preferably at least two such disks fixed to driving shafts that are bearinged in a support and placed side-by-side with their upper sides facing away from the floor surface. The circles traced out by the outer edges of the disks are placed so as to be in contact with each other or, more particularly, are overlapped with each smoothing disk having side flats that are at an angle of 90 deg with respect to the next disk or disks. It is possible to have an adjustable pressure control unit between the support and the smoothing disks for controlling the force of the disk or disks against the floor surface. This pressure controlling unit may be fixed to the support and may have a pressure feeler, acted upon by an adjustable spring, the pressure feeler being in the form of a pressing plate acting on the surface of the floor covering so as to be able to be moved across it. The support may be fixed to a height adjustment unit placed between it and the fixing means for the floor working head. The pressure controlling unit may further have a contacting means so that the height adjustment means may be so controlled and so that the pressure plate resting on the surface of the floor covering and the smoothing disks are lined up in a single plane. With such a design of the floor surfacing head, one may be certain of producing a very smooth surface on the floor covering material.

With the adjustable pressure controlling unit for the smoothing disks as noted, it is possible to get the best possible pore sealing effect in keeping with the type of floor covering material used. The pressure feeler makes it possible for the pressure of the smoothing disk on the surface of the floor coating to be continuously monitored and to be automatically controlled.

It is furthermore possible for the machine to have conveying plates on the floor working head that are placed next to each other and joined together so as to take the form of an endless chain belt running between two chain bend points. The conveying plates may have transporting spades sticking out from the ends thereof and designed to be moved with them. This system is of special value for processing the surface of the floor covering.

It is furthermore possible for each link of the boom or jib to be made up of a rocking body with a pivot shaft supported in tapered roller bearings at the end sides of the rocking body and of a rocking fork on the opposite, coupling side of the link, for keeping the pivot shaft of the next boom link in place. Furthermore, each pivot shaft, which is locked axially in position in the pivoting body, has its upper end inserted in a positioning hole in the top fork arm of the next fork of the next boom link while its lower end is seated in a semi-circular hole having a widening cutout extending from its side. The overall height measured from the lower end of the rocking body to the top face of the pivot shaft is equal to or smaller than the clearance spacing between the fork arms.

There may furthermore be means for locking the lower end of the pivot shaft in the semi-circular hole.

These further possible design points used in the machine of the present invention make it possible for the boom to be quickly and simply assembled and taken down again. Equally important is the fact as well that the length of the boom may be simply and quickly changed to be in line with the needs of a given job with the boom still being precisely level.

Further useful objects and details of the present invention will be seen from the following detailed description of a preferred embodiment of the invention, when considered in conjunction with the accompanying drawings in which like numerals in the several views refer to corresponding parts.

DESCRIPTION OF THE PREFERRED EMBODIMENT

Figure 1:
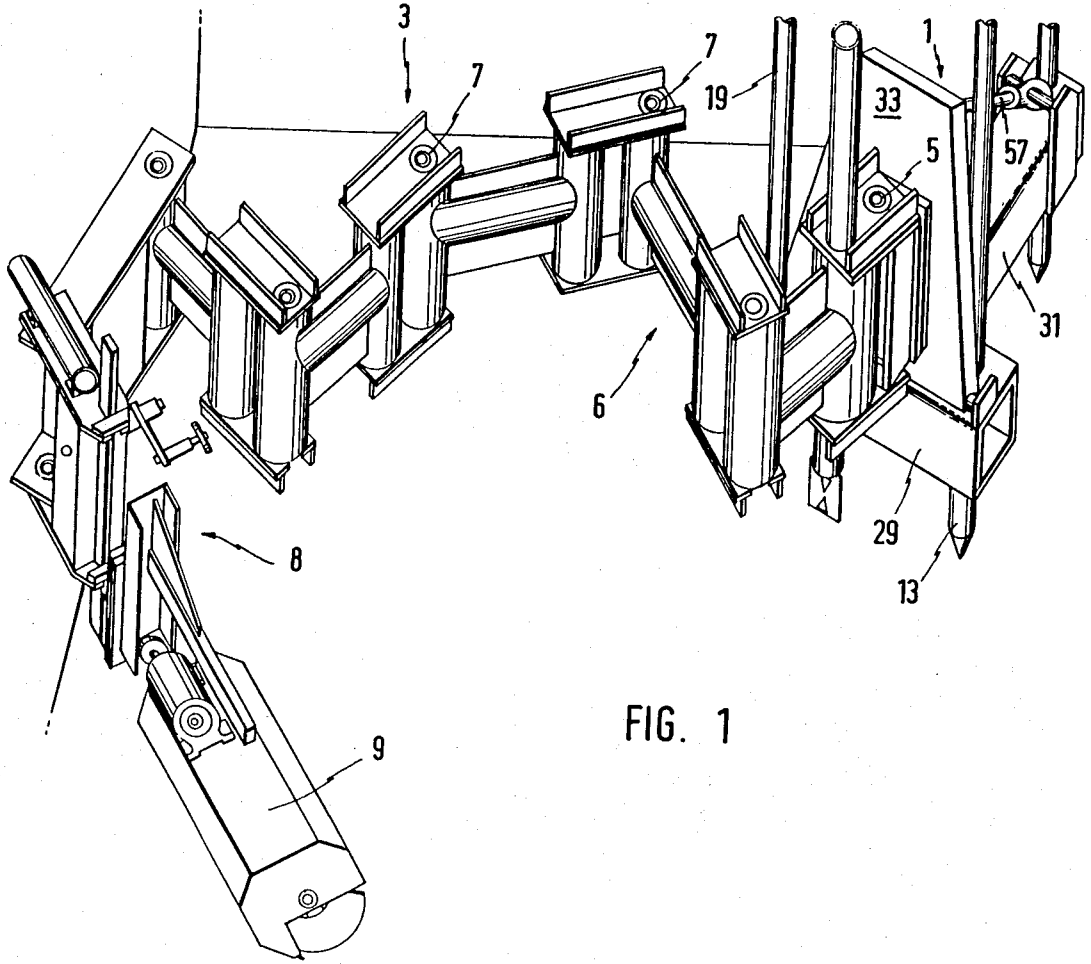
FIG. 1 is a perspective view of the floor surfacing machine with the support and load-bearing unit in keeping with my invention.

In FIG. 1 the reader will see a floor surfacing machine with a support and load-bearing unit 1 to which a horizontal boom 3 is joined so that it may be pivoted about an upright shaft 5. For its part the boom 3 is made up of a number of articulated boom links 6 that may be pivotally joined in relation to each other at their pins 7. At the free outer end 8 of the boom there is a floor working or surfacing head 9 making it possible for all different floor covering compositions to be put down, more specially fusible ones that have to be laid in a hot condition, such as asphalt.

As the reader will furthermore see from FIGS. 2 to 5, the support and load-bearing unit 1 is made up of an adjustable anchoring base unit with three feet 13 at the corners of a triangle. On the top side of the adjustable anchoring base 11 there is an anchoring unit 15 in the form of three bracing columns 19 that may be driven upwards in an upright direction by cylinder actuators 17. The top ends of the columns 19 have flat heads 23 (see FIG. 4) that are braced against the floor or roof over the machine. To allow adjustment of the machine to be used in buildings with different floor heights, the columns 19 are made in the form of telescoping parts 19*a* and 19*b* that may be locked at a given degree of extension by a pin (not shown) slipped into aligned holes 25 in the parts 19*a* and 19*b*. By driving out the actuators 17, each of the bracing columns 19 may be pressed against the upper floor, ceiling or roof.

In order to make it possible for the support and load bearing unit 1 to be used in large single-story buildings as well, the anchoring unit has, in place of or in addition to the bracing system, level legs 81 (see FIG. 3) which may be pulled out from the sides of the adjusting anchoring base 11 and from the back end thereof. The legs may however be designed so that they are fixed in position. At their outer ends (see more specially FIG. 5) the legs have holes or slots 83 by which the legs may be pinned to the floor thereunder, for example using anchoring bolts set in concrete floor material so that the supporting and load-bearing unit 1 is kept firmly in place on the floor 27 in the process of being covered.

Because the floor anchoring means or bracing system 19 is made up of three columns placed at the three corners of a triangle, it is possible to make certain that the adjustable anchoring base 11 is kept firmly in position. The main parts of the anchoring base 11 are a box beam 29 running across the base and a box beam 31 running in the length direction.

There is a leveling unit forming a separate part of the adjustment anchoring base 11 in such a way that it may be moved in relation to it, as will be made clear hereinafter. The leveling unit is comprised of a pivot plate 33, which may be pivoted at its lower end about a level shaft parallel to the box beam 29. A horizontal shaft 35 in the form of a length of tube 37 has its two ends journaled in eyes 39 made of metal plate. For reinforcing, the pivot plate 33 has plates 41 screwed, rivotted, welded or otherwise attached to its lower end. These plates are also welded to tube 37.

On the back side 43 (see FIGS. 2 and 4) of the pivot plate 33 a cross pin 45 is fixed in position by a box-like structure 47, the pin 45 running through the bearing of a rod end 49. At the back or left hand end of the box beam 31 running in the length direction, a further cross pin 53 is fixed in position by a double bracket 51 welded on the said box beam 31. The pin 53 is threaded through a further rod end 55 that is joined with the other rod end 49 by a strut 57 of adjustable length.

Figure 4:
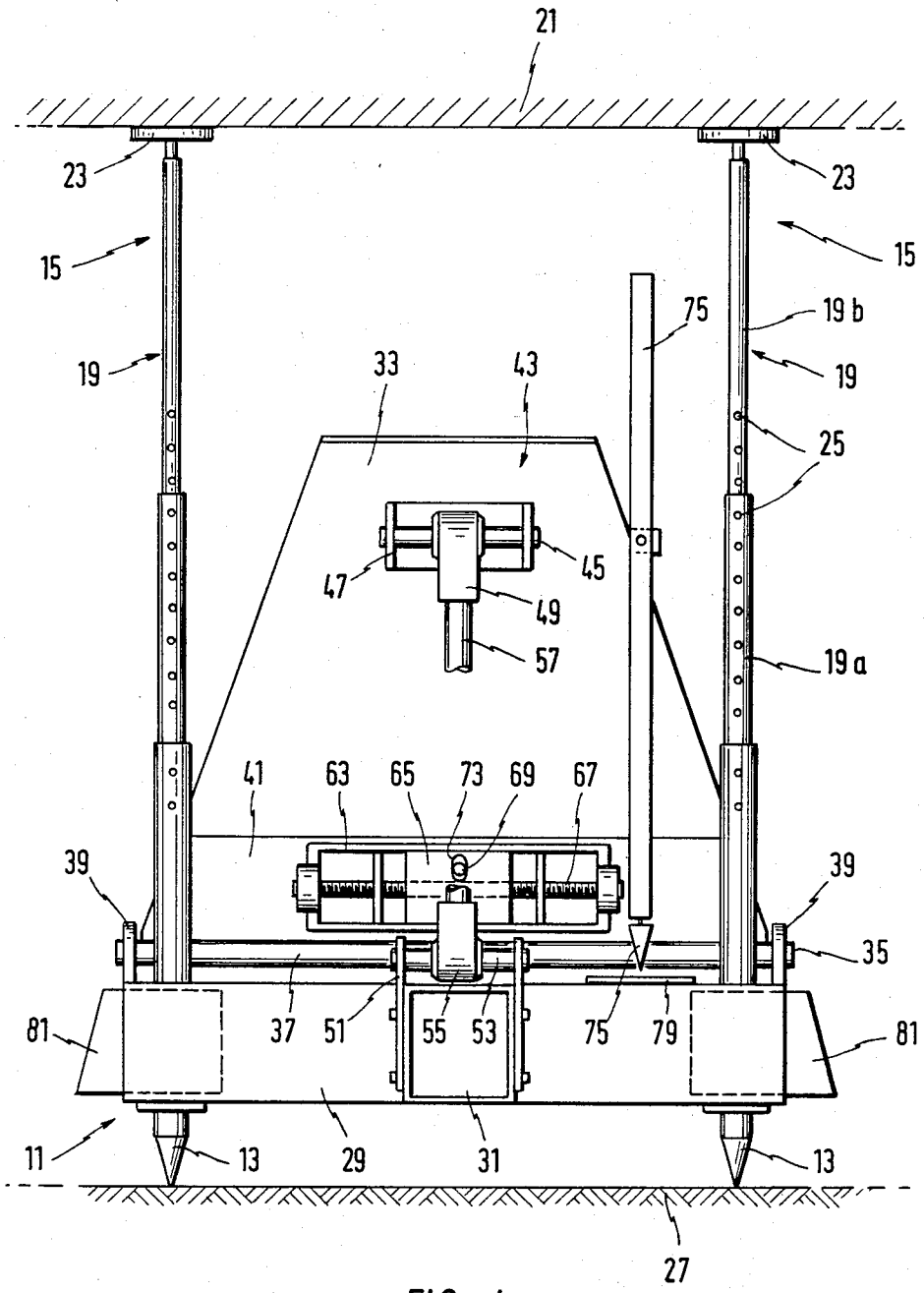
Figure 5:
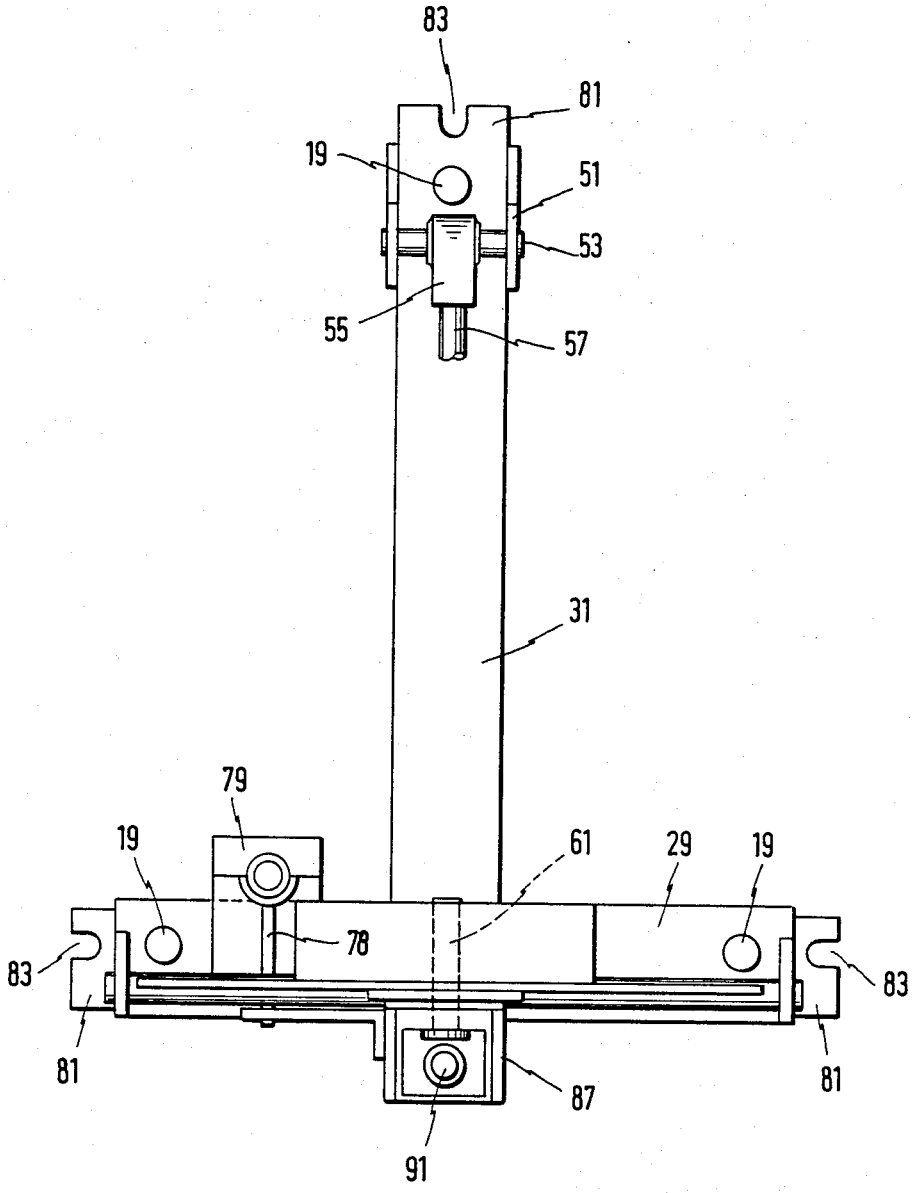

The strut 57 has screw threads of opposite hand on its two ends that are taken up in the rod ends 49 and 55 so that by turning the strut 57 the pivot plate 33 may be pivoted backwards and forwards to some limited degree to put the pivot plate into a truly plumb position by moving it in a plane running in the length direction of the unit. In FIG. 4 the strut 57 will only be seen in part.

The second leveling unit is made up of an adjusting and supporting plate 59 (see FIG. 2) that is able to be turned about a turnpin 61 in the top part of the pivot plate 33. In the lower part of the adjusting and supporting plate 59 there is a sliding guide 63 (see more specially FIG. 4) running parallel to the level shaft 35, in which an adjustment slide 65 may be moved along on turning a threaded rod 67 which is so journaled that it is not able to be moved along its axis. In the lower part of the adjusting and supporting plate 59, there is a pin 69 running in the lengthways direction through a crosswise slot 71 in the rocking plate 33 towards the adjustment slide 65 placed on the back side 43 of the rocking plate 33. The back end of the pin 69 running in the length direction is taken up in a vertical slot 73 without any play in the direction of the length of the threaded rod.

In this system, by turning the threaded rod 67, the adjustment slide 65 is moved and the lengthways extending pin 69 is pivoted in the crossways direction. As a result, the adjusting and supporting plate 59 is rocked about its top turnpin 61. Because the lengthways pin 69 is moved along a somewhat curved line in the adjustment slide 65, the opening therefor is in the form of the vertical slot 73 and the crosswise slot 71 is somewhat curved in form as well.

Because the adjusting and supporting plate 59 is used as a connection for fixing the boom 3 in place, by turning the strut 57 and the threaded rod 67, it is readily possible for the two leveling units, operating at a right angle to each other, to be trued up to accommodate any slope of the anchoring base 11.

The adjusting unit furthermore has a plumb line 75 within a tubular casing that is fixedly joined with the adjusting and supporting plate 59 by way of a rod 78 so as to be rocked therewith. The lower end of the plumb weight is pointed and directed towards a plate 79 with markings, as for example concentric circles, so that the leveling operation may be accurately undertaken every time it is necessary to get the same results.

The unit further has transport or road wheels 85 that may be folded back clear of the ground when out of use.

Figure 2:
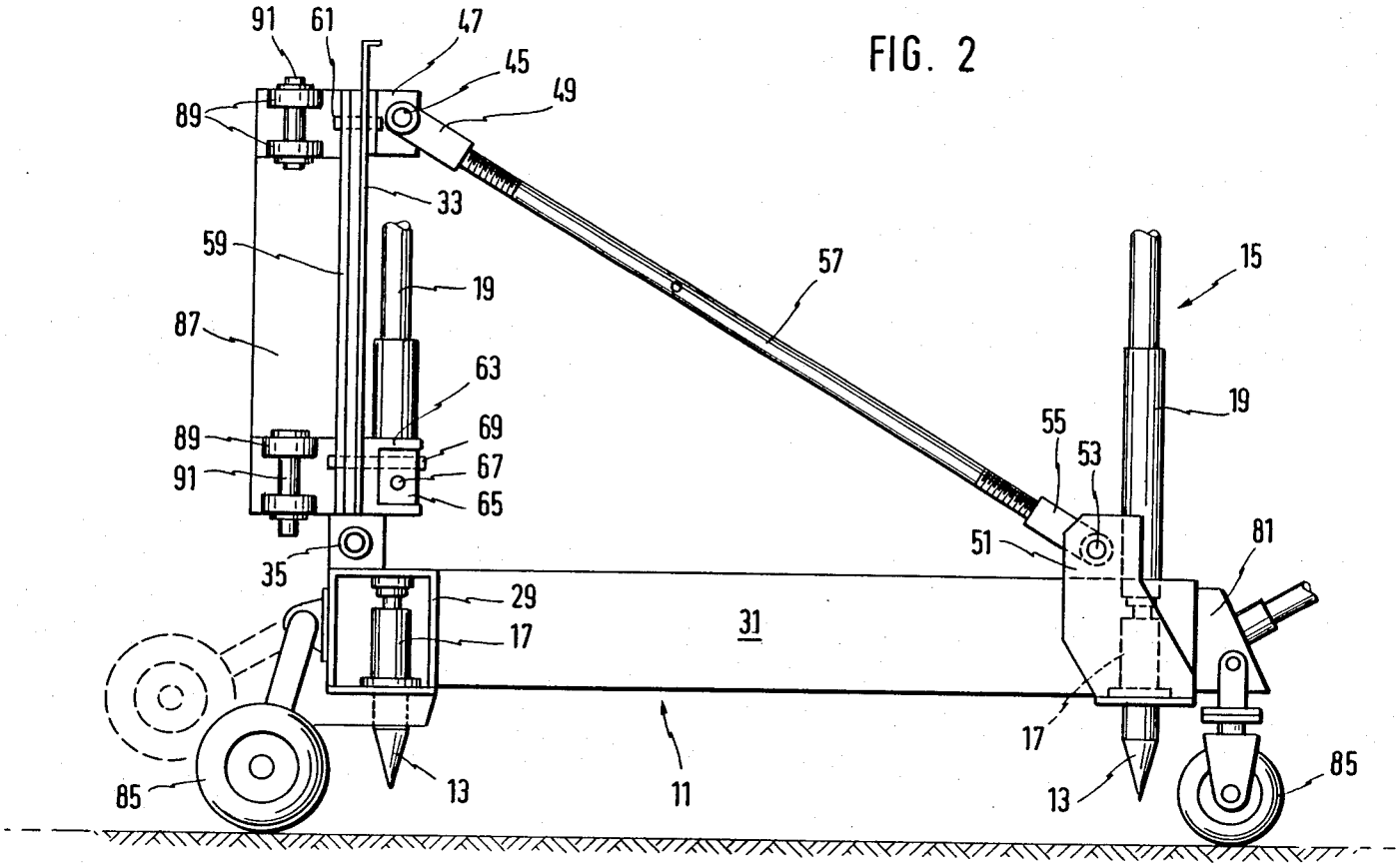
FIGS. 2–5 are respectively a side view, an end-on view, a rear view and a plan view, of the support and load-bearing unit as seen in FIG. 1.
Figure 3:
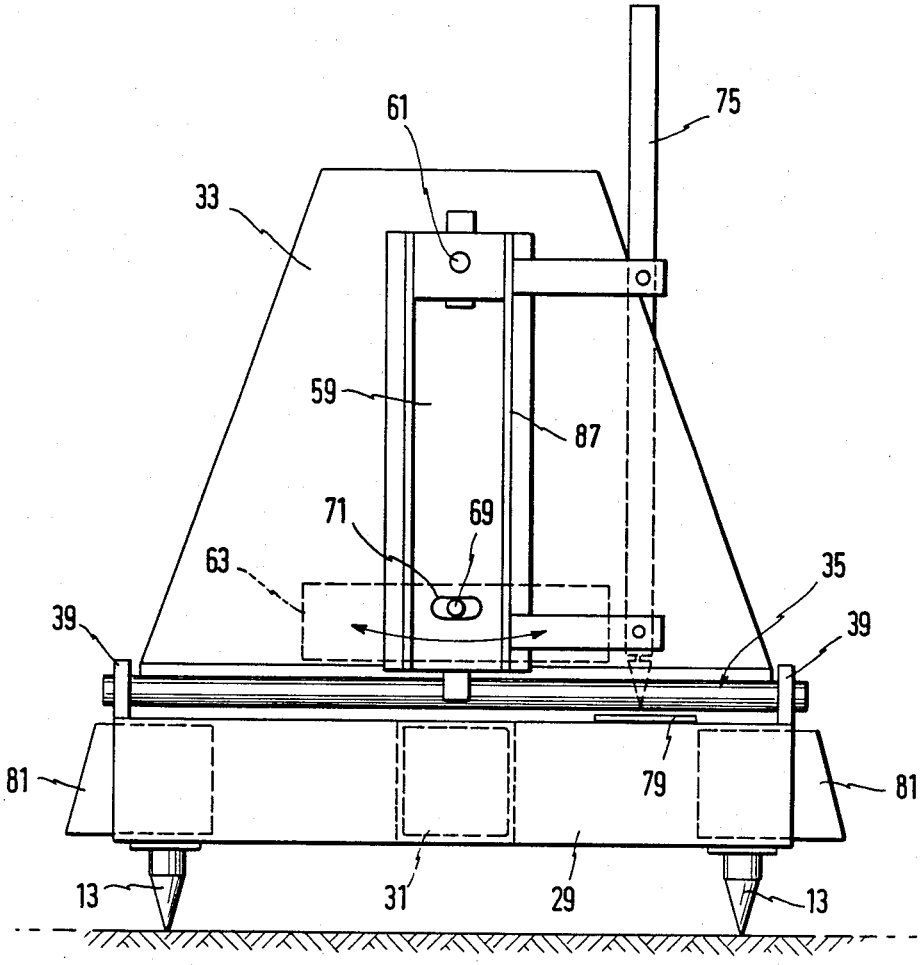
Figure 6:
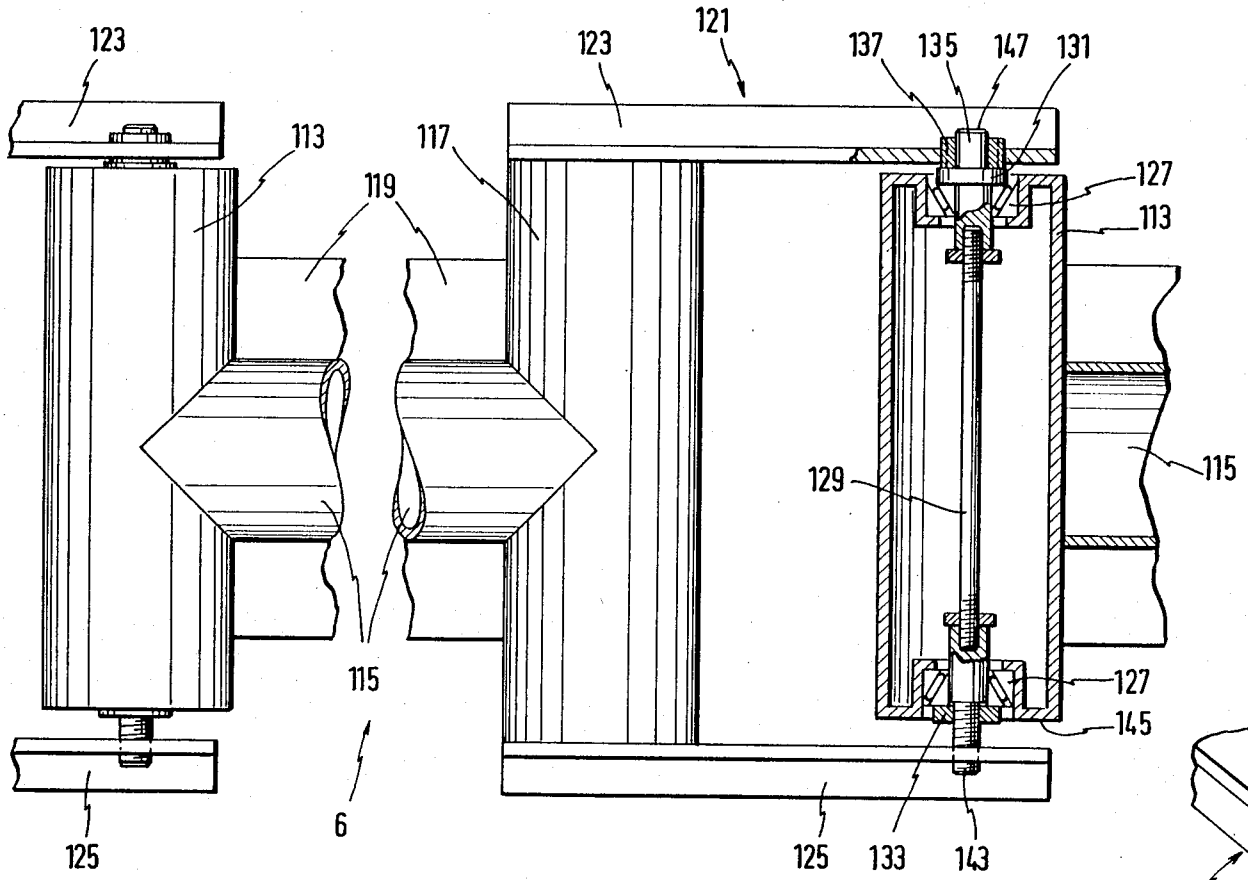
FIG. 6 is a side view of a boom link as seen partly in section.

With reference to FIGS. 2 and 6, the boom links 6 will next be described. It may be noted that the first boom link is joined with a connection member 87 (welded to the adjusting and supporting plate 59) by way of a pivot shaft 91 that is journaled in taper roller bearings 89.

The boom link 6, that is to be seen partly in section, is in the form of a generally H-like tube structure, made up of the upright pivoting body 113, the level tube part 115 and the upright tube part 117. For further increasing the stiffness of the structure there are two reinforcing webs 119 over and under the middle tube part 115.

Connected with the upright tube part 117 of each such link 6 there is a rocking fork indicated generally at 121, said fork having an upper fork arm or prong 123 and a lower fork arm 125 that are generally parallel to the tube part 115. It will be clear from FIG. 6 that the left hand boom link 6 is joined up with a next succeeding link 6 which is only partly shown.

Each pivoting body 113 has at each end a taper roller bearing 127 to receive a pivot shaft 129 so that it is radially- and thrust-bearinged in the said body 113. The bracing of the pivot shaft 129 is by way of an upper thrust washer 131 that may, if desired, be made part of the shaft 129 and at the lower end by a counter thrust washer 133 screwed onto the pivot shaft 129.

The top end 135 of the pivot shaft 129 is journaled for rotation in a hole in a bearer bushing 137 with a close fit. The bushing 137 is screwed into a hole in the arm 123 for height adjustment thereof with its lower face resting on the thrust washer 131.

Figure 7:
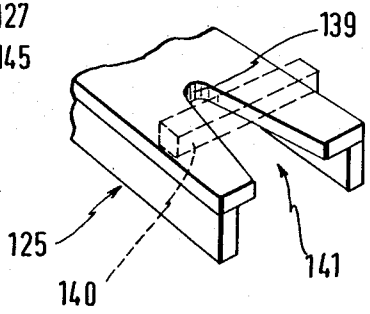
FIG. 7 is a perspective view of the lower fork arm.

The lower end of the pivot shaft 129 is joined with the upper horizontal web of the lower fork arm 125 This web has a V-shaped opening 139, 141 (see FIG. 7).

If for example, the boom link 6 taking up most of FIG. 6, is to be uncoupled from the link next to it after completing a flooring job, it is only necessary for the boom link 6 to be lifted in relation to the link on the right until the top end 135 of the pivot shaft comes clear of the hole in the threaded bushing 137. It is then only necessary for the lifted link 6 to be moved horizontally to the left (in terms of FIG. 6) so that the lower end 143 of the pivot shaft 129 is pulled out from the V-cutout 141 in the lower fork arm 145. For assembly the steps are undertaken in the reverse order. In the present example, it is clear that the distance between the lower end face 145 of the rocking body 113 and the top end face 147 of the pivot shaft 129 is less than or equal to the clearance distance of the fork arms.

There is a locking member 140, marked in broken lines in FIG. 7, for locking the pivot shaft 129 in the apex of the cutout 141 at the lower end 143.

This design makes it very simple for the boom to be erected and dismantled while at the same time maintaining accuracy of the boom 3 precisely leveled.

With the aid of of FIGS. 8 to 10 one embodiment of a floor surfacing boom head in keeping with the invention will be explained.

The surfacing head 9*a* is joined to the outer end 8 of the boom, as may be seen from FIG. 1 for example.

Figures 8, 9:
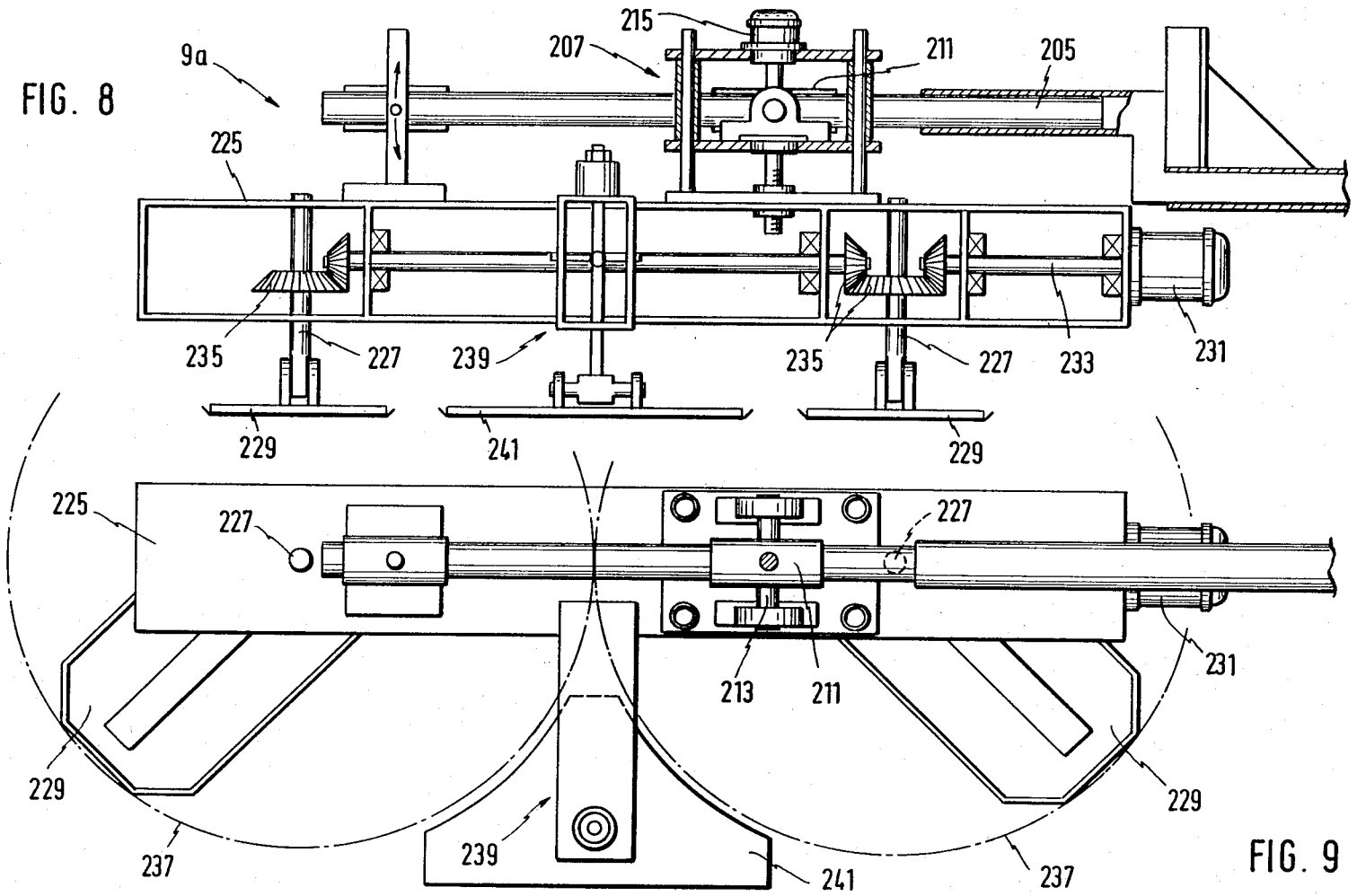
FIG. 8 is a side view of the floor surfacing head in section.
FIG. 9 is a plan view of part of the structure as viewed in FIG. 1.

As will be more specially seen from FIG. 9, the head has floor smoothing members 229 that are mainly of a rectangular form, and whose corners may be rounded off if need be. Furthermore the edge of each smoothing member is bent out of the plane of their lower working faces.

The smoothing members 229 are turned by a motor 231 acting through a cross shaft 233 and bevel gearing 235 as needed therefor. As the reader will be able to see from FIG. 9, the circles traced out by the outer round edges of the working faces 237 of the disks are touching. Because the rectangular forms of the smoothing disks 229 are out of phase by 90 deg from one disk to the next, the driving shafts 227 may be put nearer together so that the circles traced out by the outer limits of the working faces actually overlap.

An account will now be given of the controlling operation of a height adjuster 207, with a pressure feeler 239 for sensing the height or level of the flooring material being laid of screeded.

The pressure sensor or feeler 239 (see FIG. 10) has a pressure feeler plate 241 resting on the floor covering being produced or processed, the plate being fixed to an upright sliding bolt 243, that, for its part, is fixed in a support 225 so that it may be moved up and down in relation thereto. The bolt, and the feeler plate 241, are acted upon by a spring 247 pushing them towards the surface of the floor covering with a force that may be adjusted using a screw 249 at the top end of the bolt 243. The upright motion is limited by stops 251. It is furthermore possible to have an oppositely-acting spring with a lesser spring force in order to keep the bolt 243 with its upper stop 251 in a neutral, starting position.

There is a flexible contacting arms 253 fixed to the bolt 245 which in the neutral position of the bolt is between two contacts 255, the same being joined up by wiring (not shown) with the motor 215 of the height adjuster 207.

An account will now be given of the operation of the floor surfacing head or unit.

Before starting a flooring job, the floor surfacing head or unit 9*a* is first manually adjusted to the desired height by way of a height adjustment unit (not figured in detail) on the supporting and load bearing unit or on the end of the boom itself, such height being the datum level for the height of the floor covering material. An important part in the operation of the unit 9*a* is played by the two smoothing disks 229, that, as we have seen, are driven by way of the motor 231 on the support 225 and the shafts 227, this being a simple and readily undertaken way of producing a generally smooth surface on the floor covering material. In addition, the edge of each smoothing disk 229 that is to the front may have a routing cutter placed at a higher level than and in front of it for the purpose of forcing superfluous flooring material out of the way.

For producing the smoothest possible floor covering steps are necessary to see that the pores of the material are fully closed, something only possible if the acting pressure is carefully matched to be in line with the properties of the floor covering material being laid. To make such an adjustment the adjustment screw 249 is turned till the feeler plate 241 is resting on the flooring material surface with the desired force.

Assuming that the smoothing disks 229 have been adjusted in the right way, they will then be pressing on the floor surface with the right adjustment of the force. If, for example, the density of the covering material becomes less, the feeler plate 241 of the feeler 239 will be moved downwards to a lower level on the surface of the covering and the contact arm 253 will be moved onto the lower contact 255 so that a threaded rod 217 will be turned by the height adjustment motor 215, the said rod 217 moving the slide 219 and the support 225 downwards till the contact arm 253 is moved out of electrical contact with the lower contact 255. Because of this the smoothing disks are caused to take effect on the floor surface with the necessary force again.

If on the other hand it is a question of the floor covering material being overly dense or thick at a given position, the feeler plate 241 of the pressure feeler 239 will then be moved against the force of the spring 247 upwards somewhat so that the contact arm comes up against the top contact 255 and the motor 231 will now be driven in the opposite direction lifting the support 225 with the smoothing disks 229 thereon til the arm 253 is moved electrically clear of the contact 255 into its neutral position between the two contacts 255.

In this way it is possible to be certain that the smoothing disks 229 are automatically controlled so that the force with which they are acting on the floor surface is in keeping with the desired value.

A further point to be noted is that size of the height adjustment of the smoothing disks may in some cases only be a fraction of a millimeter.

The generally wedge-like pressure plate 241 is placed right in the space or bay between the two acting faces 237 of the smoothing disks, the pressure feeler 239 being in front of the floor surfacing unit in the direction of motion thereof. Furthermore by way of the short shafts 213 (FIG. 10) the complete support 225 may be floatingly supported on the height adjustment system. Using slots in the tube 205 running in the length direction or in the short tube 211 it is furthermore possible for the height adjustment unit to be rocked in the length direction as well for some special jobs.

Figures 10, 11:
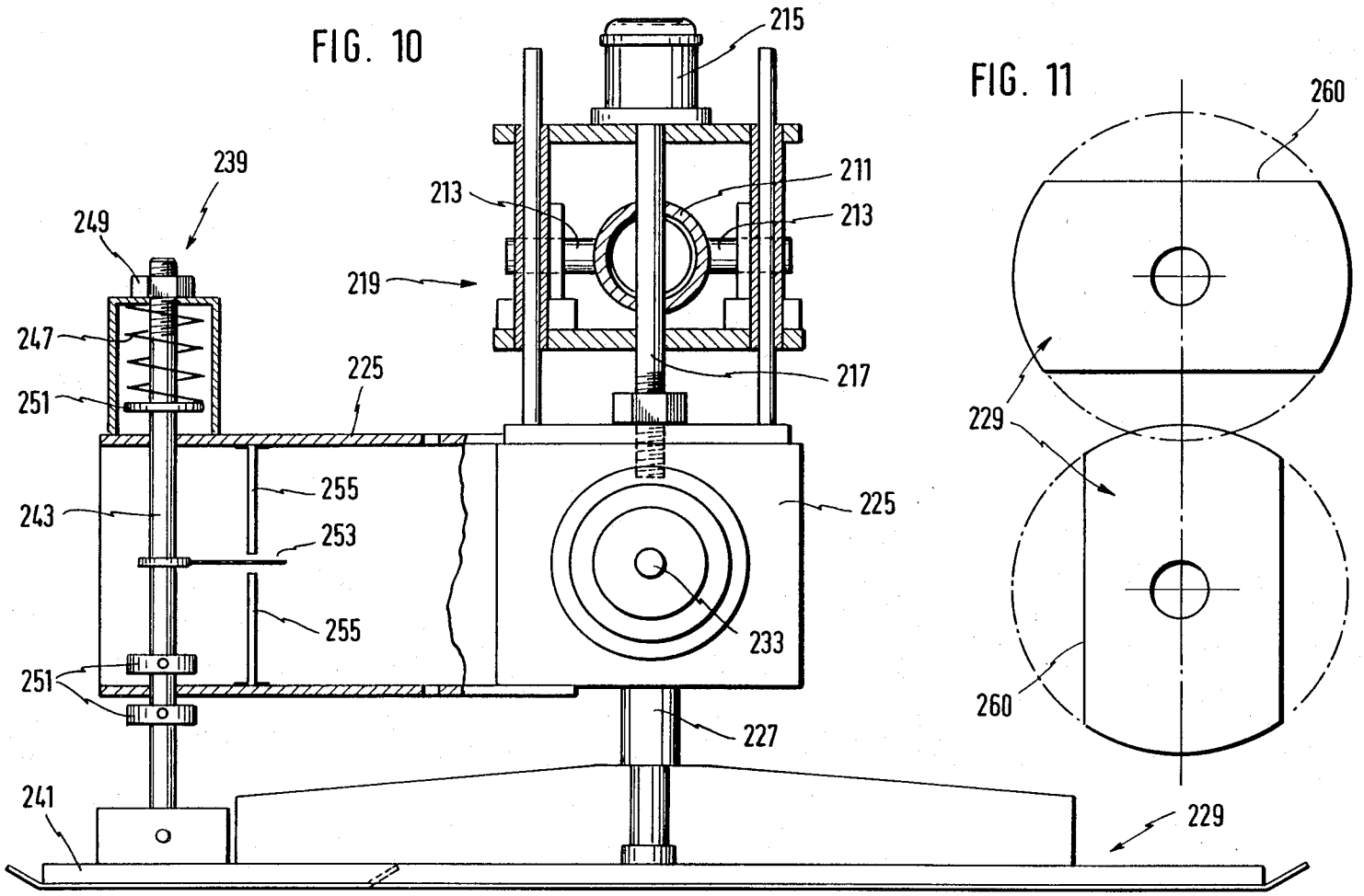
FIG. 10 is an end-on view of the floor surfacing head.
FIG. 11 is a plan view of a further possible form of two turning smoothing disks.

In FIG. 11, the reader will see a somewhat changed form of the two smoothing disks 229 placed side-by-side in which the disks have a round outline over predetermined arcs but having opposed flat edges 260 that are parallel to each other. The flats are of a size designed so that they create a generally round pattern having use, with the circles traced out by each overlapping.

Figure 12:
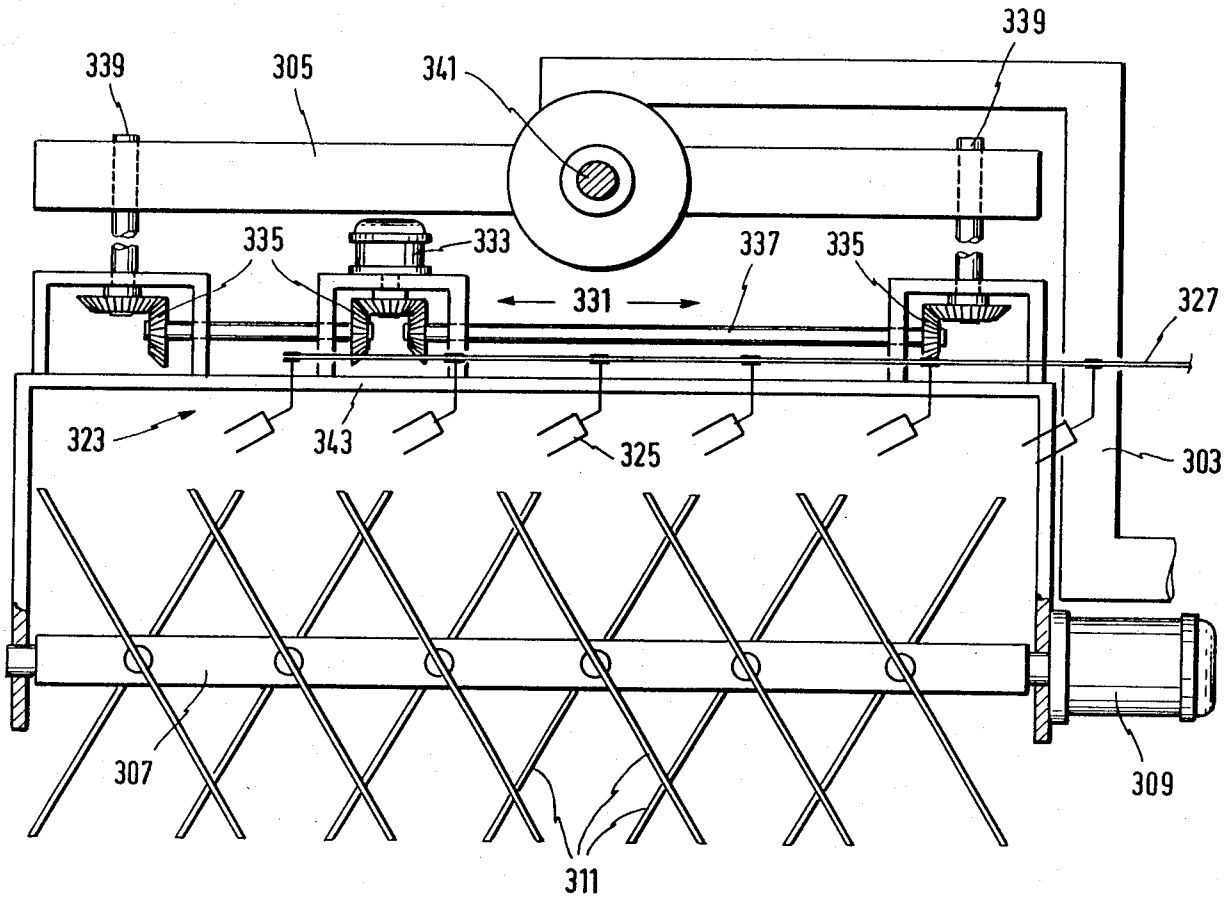
FIG. 12 is a diagrammatic side view of a second form of floor surfacing head.
Figure 13:
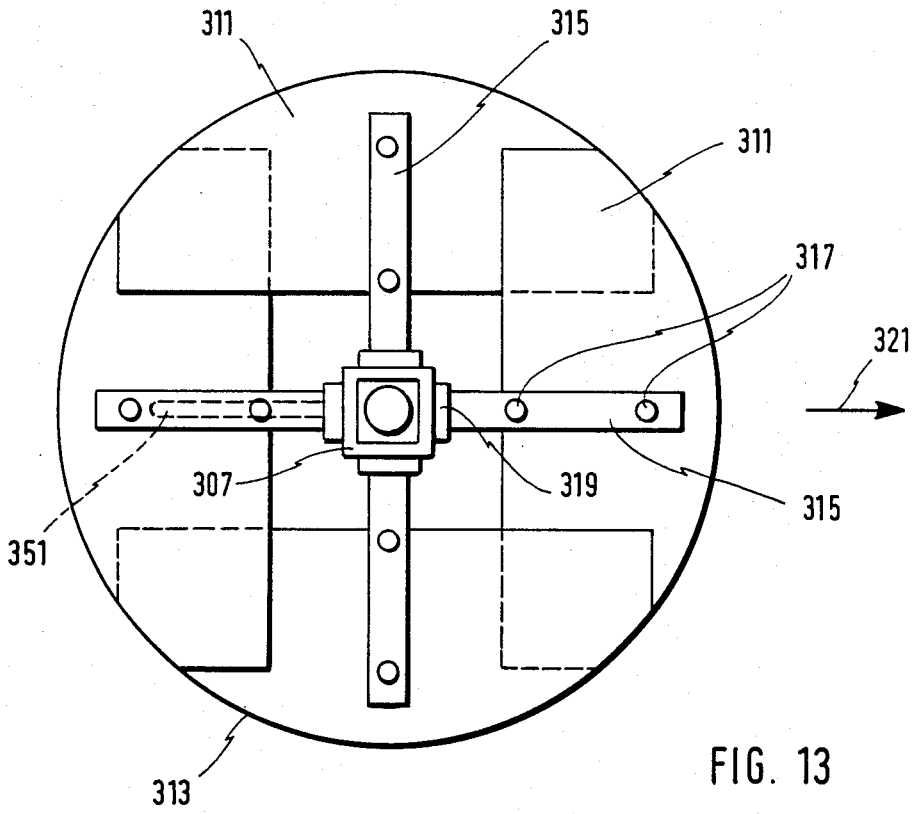
FIG. 13 is an end-on view of the floor surfacing head.
Figure 14:
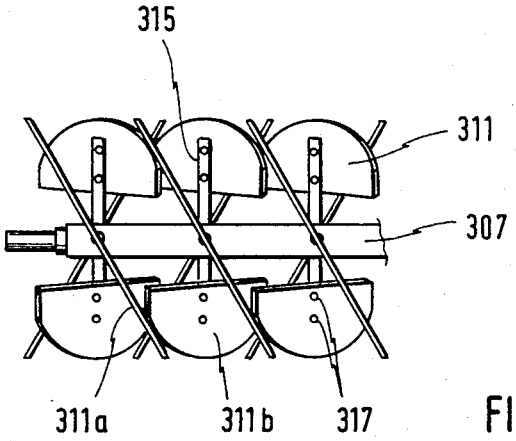
FIG. 14 is view of a further working example of the floor surfacing head with further planing paddles.

An alternative arrangement of a floor surfacing head can be seen with reference to FIGS. 12–14. Here, a connection piece 303 is provided for joining the head to the end 8 of the book. The surfacing head has a support frame 305 with a driving shaft 307 running along its length and journaled so that it may be turned continuously by a motor 309. In the embodiment shown in FIGS. 12–14, the driving shaft 307 is preferrably a piece of square tube with spaced planing or screeding paddles or blades 311 fixed along it. As will be seen from FIG. 12, the planing paddles 311 affixed to the side of the driving shaft 307, facing the reader, are at an angle of about 60° to the driving shaft 307 and are regularly spaced out along the shaft. Affixed to the other side of the shaft, i.e., away from the reader, there is a second line of such paddles that are spaced 180° from the first line. The paddles of this second line are also placed at approximately equal angles of 60° to the shaft axis and are axially symmetrical disposed relative to the first line of paddles. Referring to FIG. 13, the planing paddles 311 are in the form of circle segments with their corners cut back. The side view of FIG. 13 is a view of a form of surfacing head shown in part in FIG. 14, but in which there are two further lines or rows of planing paddles 311 placed at an angle. Here, the planing paddles have an equal spacing in the length direction of the shaft and each of the four lines of paddles is at an angle to its adjacent neighbor there being an equal angle between the lines of paddles with radial symmetry.

In place of the square tube shaft 307 the shaft might be a piece of round tube or a tube with three, five or six sides with an equal number of rows of paddles. Furthermore the paddles of a line or row do not have to be in a single radial plane as is more specially to be seen from FIG. 13. The curved form of the outer edge 313 of each planing paddle is such that it is in keeping with the line at which the paddle would be cut by a cylinder centered on the shaft.

The optimum angle range for the oblique positioning of each planing paddle to the driving shaft 307 has turned out to be 30 deg to 85 deg. In the present embodiment, with an angle of 60 deg, the size of the planing paddles in four lines is such that the curved outer edge of each planing paddle is on a common helical line with the next paddle thereto which is at a different angle on the shaft. In FIG. 14 this will be seen, for example, in the case of the planing paddles 311*a* and 311*b*.

As will furthermore be seen from FIG. 14, the packing density and angle of the planing paddles is such that there are four interleaved spiral outer edge lines. Putting it differently, the curved outer edges of the paddles are like the separate threads of a four-start screw. With such a design it is possible for the floor covering material to be worked on an even level while running the shaft at a low speed without the formation of proud strips of material and without having material thrown about unnecessarily.

As can be seen from the partial view of FIG. 13, the planing paddles 311 have inner shanks 315 running along their axes of symmetry towards the shaft and away from their outer edges. The shanks 315 are joined by screws or rivets 317 or, for example, by welding to the paddle bodies. The radially inner ends of the shanks are screw-threaded so that they may be screwed into tapped holes in the driving shaft 307 and locked accurately in the desired positions by way of lock nuts 319. This makes it possible for the floor covering surfacing head to be simply adjusted in the way needed and any damaged paddles may be readily and simply taken off and new ones put in their place.

While the machine is, working the head at the end of the boom is, for example, moved laterally in the direction of the arrow 321 and with the shaft, as observed in FIG. 13, running counter-clockwise.

In order to make certain that there is no chance of fusible floor covering materials, as for example asphalt, being chilled by the planing paddles or blades and setting thereon so that the paddles would have to be frequently cleaned, a heating unit 323 is provided (see FIG. 12) that is made up of a number of burners or burner nozzles 325 spaced out in row parallel to the driving shaft 307 and joined up with a gas supply pipe 327.

The heating unit is in this respect so designed that the burners 325 are all placed pointing towards the transport side and sloping towards the face of the flooring material for heating same from the broad side. By using automatic control systems, not shown, the rate of gas supply, and for this reason, the temperature of the material, may be changed and adjusted. The number of the burners is equal to the number of paddles in an axial row thereof.

Electrical heating coil elements 351 placed in the planing paddles may be used in place of gas heating.

As will be seen diagrammatically in the FIG. 12, floor working head 9 furthermore has a height adjustment unit 331 that is made up of a motor 333 driving upright lead screws 339 by way of bevel wheels and shafts 335 and 337. When the motor 333 turns the driving shaft 307 journaled in the frame 343, the frame, together with the planing paddles 311, are moved upwards in relation to the frame 305. This makes it possible for the head 9 to be quickly and simply adjusted in keeping with the nature of the floor being worked on. In practice the support 305 will not only be kept in place by way of the lead screws 339 but, furthermore, by way of an upright slide, to make certain that the support is kept firmly in the desired position.

As will also be seen from FIG. 12, the support 305 is joined up with upwardly running frame 303 by way of a cross shaft 341 so that the floor working head may be floatingly supported and the position thereof will be automatically adapted to sloping floors.

By using a locking device, not shown the support frame 343 with the housing frame placed thereunder may be fixed and firmly locked in a level position or at a slope as may be desired.

Figure 15:
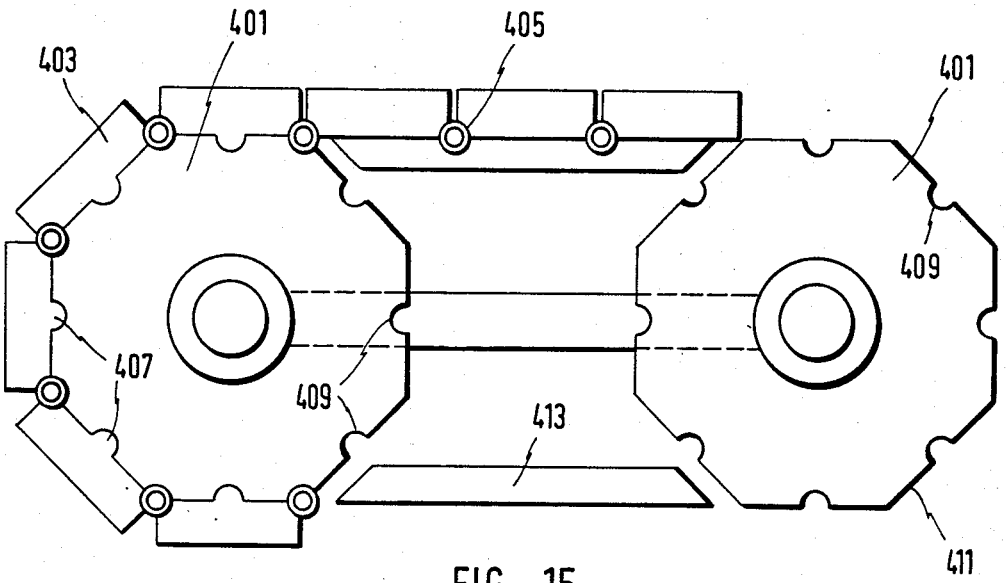
FIG. 15 is a diagrammatic side view of a still further floor surfacing head.
Figure 16:
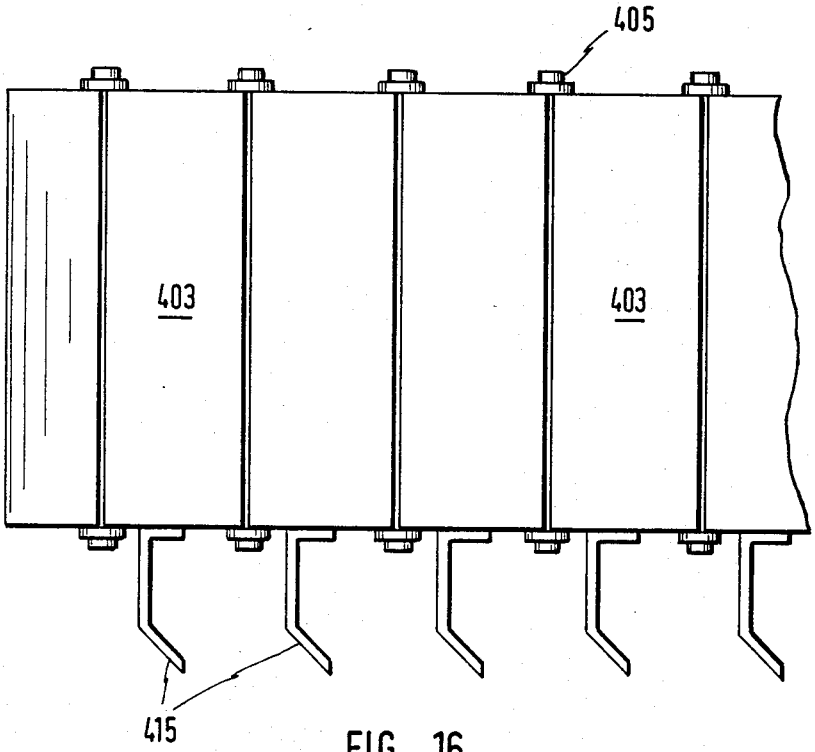
FIG. 16 is a diagrammatic plan view of the head as seen in FIG. 15.

FIGS. 15 and 16 show a further example of a floor working head 9 that may be removably coupled to the outer end 8 of the boom. The main parts of the floor working or processing head in FIG. 15 are two drums 401 around which a track, made up of parallel conveying plates 403, is run. The conveying plates 403 are joined together on their long sides at pivot joints 405 so that they may be rotated relative to each other. Furthermore, the plates have dogs 407 on their inner sides taken up in the grooves 409 in the drums 401. In the present example the drums 401 have flats 411, each of the size of a plate 403. To make it possible for the floor surface to be acted upon with the desired pressure between the drums 401, there is a support plate 413 at a position so that the conveying plates are pressed against the top face of the floor material at the same level.

As will be clear from FIG. 16, the conveying plates 403 have conveying spades 415 in the direction of forward motion of the floor working head, such spades moving around with the conveying plates 403 so that the superfluous flooring covering material is always evenly pushed off to the side.

Next to be explained is the main height adjustment system at the boom end 8 and in this regard, FIGS. 17 to 21 will be referred to.

As can be seen, the boom end 8 has a height adjustment unit 519 made up of an upright driving rack 521 that may be moved by a hand crank 523 turning a pinion 525 in mesh with the rack 521. Furthermore, there is a half-circular toothed ring against which a pin 529 is pressed by a spring 531 so that the crank may be locked in a desired position and the rack 521 kept at a given height. The locking pin 529 is placed on the crank 523 over the ring 527 of teeth so that by turning the crank 523 the tube-like connection part 533 is lifted and lowered with the flooring working head 9 thereon.

Figures 17, 18, 19, 20, 21:
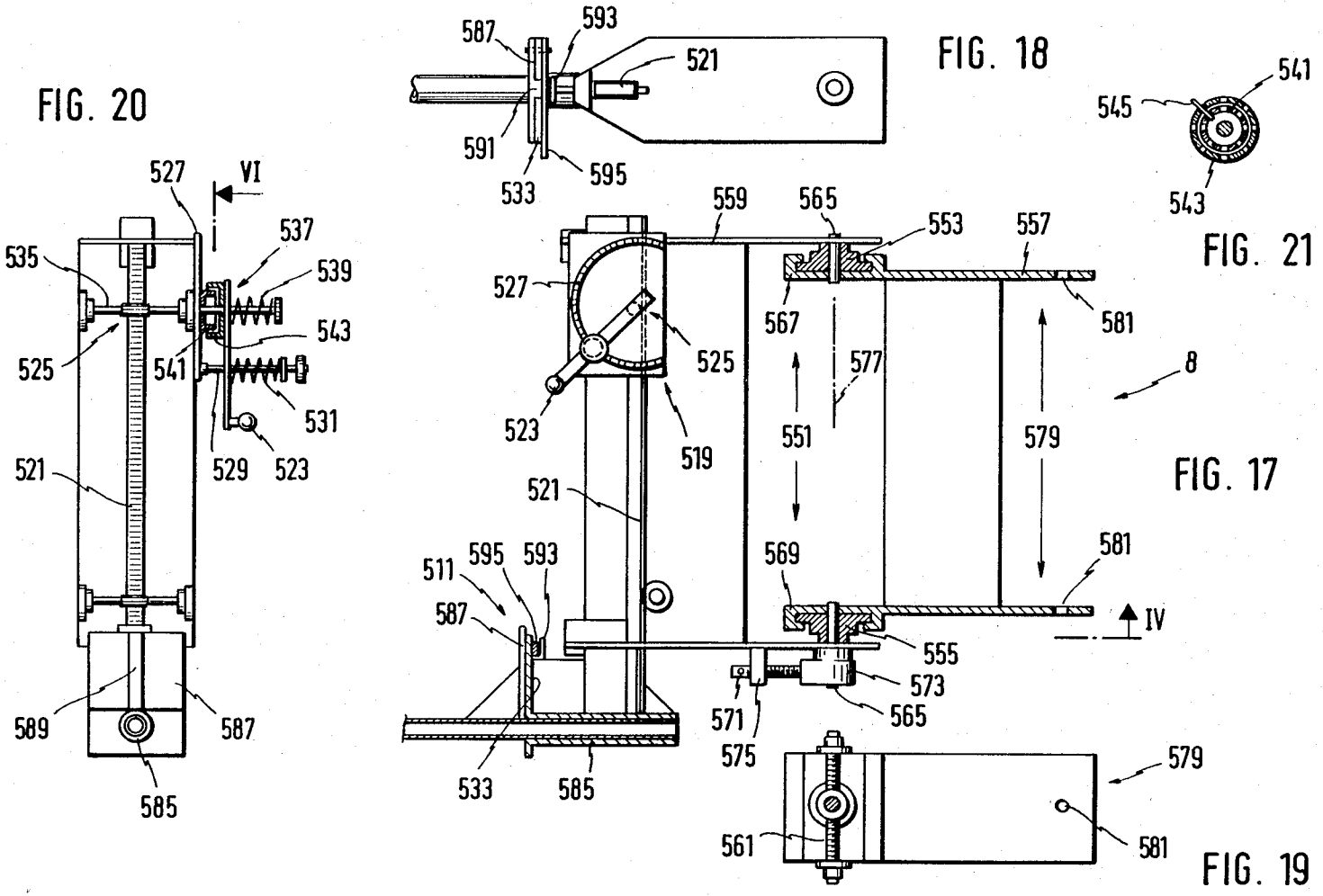
FIG. 17 is a side view of the one end of the boom.
FIG. 18 is plan view of part of the boom end.
FIG. 19 is a view, looking in an upward direction, on line IV in FIG. 17.
FIG. 20 is an end-on view of the end of the boom.
FIG. 21 is a section taken on the line VI of FIG. 20.

As will further be seen from FIG. 20, between the shaft 535 and the crank 523 there is a coupling 537 loaded by a spring 539 to make it possible for the crank to be lifted against the force of the spring 539 and adjusted over the ring of teeth without causing any change in the height of the connection part 533. As is clear from FIG. 21, the coupling itself is made up to two concentrically placed skirts 541 and 543, the inner skirt 541 being fixed to the shaft 535 whereas the outer skirt 543 is joined with the hand crank 523. There is a radial pin 545 that may be slipped into position in holes in the two skirts for the transmission of driving torque from the one to the other and, for this reason, the transmission of motion of the crank to the rack 521. Such adjustment of the hand crank 523 makes it possible for a desired initial height datum or zero point for the thickness of the floor covering material. A more specially useful effect is produced if the mechanical linkage is such that an adjustment from one tooth on the tooth ring 527 to the next one is exactly equal to an adjustment of the height adjustment unit 519 of one unit of length as, for example, 0.5 cm or 1 cm. This makes it possible to accurately size the thickness of the floor covering, keeping it within specification. Because the height adjustment 15 unit is not mounted on the support and anchoring unit 1 but instead is directly on the boom end 8, very simple and quick adjustment may be undertaken at the site of the job without the worker having to walk back to the support and anchoring base every time adjustment is needed. More importantly because the floor working unit or head is fixed to the end of the boom, the forces acting on the height adjustment unit are generally low and the unit itself may be made representatively small and freely running.

Furthermore there is a vertical fine adjustment unit 551 in the form of two cross slides 553 and 555 so that exact control of a floor processing unit or head having a tool with a flat screeding or smoothing surface becomes possible. For this purpose the end 8 of the boom is made in two pieces and has an inner load bearing part 557 and an outer pivoting part 559 with the height adjustment unit. Using the two cross slides 553 and 555 (running normal to the plane of the paper in FIG. 17) it is possible for the load bearing part 557 to be adjusted sideways in relation to the pivoting part 559 and put in line vertically with a high degree of precision, in each case using a lead screw 561 (see FIG. 9) that may be moved axially and by way of which the slide 553 or 555 in question may be adjusted in a sideways direction on the load bearing part 557. The pivoting part 559 is supported on two pins 565 sticking out from the slides and being able to be moved thereby, such pins running through cross slots in the upper and lower lengthways flanges 569 of the load bearing part 557.

For working on floors with non-planar or complex forms, as for example for forming dished hollows in floors around drain openings, there is furthermore a pivoting unit in the vertical, lengthways plane of the boom end for pivoting the boom end upwards and downwards. In this respect the outer rocking part 559 is supported on the top pin of the cross slide 553 pivotally by way of a joint (not figured in detail) so that the pivoting part 559 may be sloped forwards and lifted in relation to the load bearing part 557 about this joint. The adjustment is undertaken at the lower cross slide 555 using a lead screw 571, that is journaled and locked axially in a bolster part 573 fixed to the slide 555 by way of the pin 565. By turning the adjustment lead screw 571, a leg 575, having a hole with a female thread and which is fixed to the lower end of the rocking part 559, is moved in the length direction backwards or forwards so that, in keeping with such axial adjustment and by way of the joint (not marked in the figure) on the pin 565, the complete pivoting part 559 is angled forwards or is lifted. Because of this, the floor processing head 9, supported by way of the connection part 533, is lowered or lifted so that floor covering jobs round dish-like hollows in the floor and the like become quite simple and readily undertaken.

In order to make it possible for the floor surfacing machine to be used in very small rooms without the supporting and load-bearing unit 1 having to be changed in position, the design is such that the outer pivoting part 559 may be pivoted in relation to the bearing part 557 about it upright axis formed by the pins 565.

The boom end 8 is supported on the last boom link 6 by way of a rocking fork 579 having two holes to take up a turnpin on the last or next boom link.

In this design a floor surfacing head 9 is joined up by way of a coupling part 511 having a tube-like head part 585 with means for stopping it from turning in the form of a shoulder plate 587 (see FIGS. 18 and 20) having a groove 589. The floor surfacing head has a bearer plate 587 with a tonguepiece 591 fitting into the groove 589 so that after plugging the floor surfacing head into the tube-like head part 585 it is kept in place and stopped from turning. In order to take up bending forces, a bracket 593 may be placed on the plate 587 of the floor surfacing head, the bracket 593 pointing towards the end 8 of the boom and kept locked in position by a hinge bolt 595 fixed to the coupling part 511.

As may be seen from FIG. 17, the teeth are placed in a ring segment 527 so that the pivoting part 559 may be pivoted far backwards about the axis 577 without the half-circular ring of teeth 527 running up against the upright support portion of the load bearing part 557.

I claim:

1. In a machine for surfacing floors by spreading a floor covering material and forming such material on said floor, of the type comprising a supporting and load bearing base, a pivoting boom mounted on said base for pivoting motion about a generally upright axis at said base, said boom being made up of articulated links with upright pivot axes therebetween, a floor working head mounted on an end of said boom furthest from said base, and first and second boom leveling units on said base for acting in planes at a right angle to each other, the improvement comprising bracing means joined to said base and cooperating with at least one floor, said first and second leveling units being arranged for movement relative to said bracing means of said base and including an adjustment and support plate pivotally joined to said base and means connecting said adjustment and support plate to said boom for leveling said boom in generally all positions thereof about said base, and a height adjustment means located proximate said floor working head for positioning said head at a desired elevation relative to said floor.

2. The machine as claimed in claim 1 wherein said first leveling unit comprises a pivot plate able to be adjusted about a horizontal axis and having said means connecting said adjustment and support plate to said boom joined to a front side of said pivot plate, a strut joined to an opposite, back side of said pivot plate, said strut being of adjustable length and being joined at an opposite end thereof with said base at a point spaced from said horizontal axis of said plate, said second leveling unit including said adjustment and support plate being pivoted about an axis normal to said horizontal axis.

3. The machine as claimed in claim 1 wherein said boom further comprises a pivoting unit extending perpendicular to said upright axis of said boom.

4. The machine as claimed in claim 1 wherein said floor working head comprises a horizontal driving shaft having planing paddles mounted on and longitudinally spaced along said shaft, said paddles having rounded outer edges and disposed at substantially equal angles to the longitudinal axis of said shaft.

5. The machine as claimed in claim 4 further comprising means for heating said paddles.

6. The machine as claimed in claim 4 wherein said paddles are placed in rows extending parallel to the longitudinal axis of said shaft with the paddles of each row lined up in the axial direction.

7. The machine as claim in claim 4 wherein the outer edges of said paddles are aligned in a helical spiral pattern, said paddles being regularly spaced along said driving shaft.

8. The machine as claimed in claim 1 wherein said floor working head has at least one smoothing disk with a working face thereof opposed to said floor, said disk having a shaft fixed to the side opposite said face for driving it, said machine further comprising a support in which said disk driving shaft is journaled.

9. The machine as claimed in claim 8 having at least two such disks.

10. The machine as claimed in claim 9 wherein said two disks are placed sufficiently close to one another that, upon rotation thereof, circles traced out by outer edges thereof are at least in contact with each other, said disks having flats and being driven out of phase with one another by about 90 degrees.

11. The machine as claimed in claim 10 having an adjustable pressure means disposed between said support and said smoothing disks on said support.

12. The machine as claimed in claim 11 wherein said adjustable pressure means includes an adjustable pressure feeler having a plate member coacting with the surface of the flooring material and movable normally thereto, said height adjusting means being placed on said support for acting on said boom end, said adjustable pressure means further comprising an electrical contact means for control of said height adjusting means to keep said pressure feeler in a common plane with said disks on said material surface.

13. The machine as claimed in claim 1 wherein said floor working head comprises a number of conveying plates joined together in the form of an articulated track running between two drums of the machine.

14. The machine as claimed in claim 13 having transport spades placed on free sides of said conveying plates for being moved thereby.

15. The machine as claimed in claim 1 wherein each boom link is made up of a pivotable body with a pivot shaft mounted in taper roller bearings at one end thereof and a fork with two fork arms at an opposite end of said body for connection with the pivot shaft of another such link, said pivot shaft being designed to have its top end fitted into a positioning hole in the upper fork arm of the next said link and to have a lower end thereof fitted into a positioning opening in the lower fork arm, said opening running out into a widening cutout in the said arm for guiding said pivot shaft lower end into said opening, the overall height measured from the lower end of said pivotable body to the top end of the pivot shaft being at the most equal to the clearance distance of the said arms.

16. The machine as claimed in claim 15 comprising a locking bar for locking said shaft lower end in said opening in said lower fork arm.

17. A floor working head for a floor surfacing machine comprising:

(a) a frame;

(b) a horizontal driving shaft journaled for rotation with respect to said frame;

(c) a plurality of paddles each having a planar working face for engaging the floor to be surfaced with a predetermined pressure, said paddles being operatively coupled to said shaft so as to be driven about generally vertical axes with the path traced by at least two of said paddles intersecting in a generally horizontal plane; and (d) control means for sensing the surface contour of the floor as it is being worked upon for adjusting the pressure between said working faces of said paddles and said floor.

18. The floor working head as in claim 17 and further including heating means for heating said paddles.

19. The floor working head as in claim 17 wherein said control means comprises:

(a) a floor-engaging feeler plate mounted for movement in the vertical direction;

(b) electrical contact means operatively coupled to said feeler plate for sensing changes in the vertical disposition of said feeler plate; and (c) electrical motor means coupled in series with said contact means and mechanically coupled to said paddles for driving the working face of said paddles toward or away from said floor surface.

20. A floor working head for a floor surfacing machine, comprising:

(a) a frame;

(b) first and second sprocket drums journaled for rotation on said frame about parallel, spaced-apart axes;

(c) an endless chain comprised of a plurality of hinged plates surrounding said first and second sprocket drums;

(d) means supported on said frame for driving one of said first and second drums for moving said plates across the floor being surfaced; and (e) vertically adjustable floor surface engaging means mounted on said frame for controlling the pressure between the floor being surfaced and said ones of said plurality of hinged plates contacting the floor.

* * * * *